US006246005B1

(12) United States Patent
Mahlandt et al.

(10) Patent No.: US 6,246,005 B1
(45) **Date of Patent: *Jun. 12, 2001**

(54) RADIATING COAXIAL CABLE

(75) Inventors: Erhard Mahlandt, Hannover; Karl Schulze-Buxloh, Mönchengladbach, both of (DE)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,935

(22) Filed: Aug. 18, 1998

(30) Foreign Application Priority Data

Sep. 3, 1997 (DE) ..... 197 38 381

(51) Int. Cl.[7] ..... H01B 7/12; H01B 7/18
(52) U.S. Cl. ..... 174/102 R; 174/102 SP
(58) Field of Search ..... 174/102 SC, 102 SP, 174/102 R, 36

(56) References Cited

U.S. PATENT DOCUMENTS

| | | | | |
|---|---|---|---|---|
| 3,106,713 | * | 10/1963 | Murata et al. | 343/770 |
| 4,280,225 | * | 7/1981 | Willis | 455/55 |
| 4,322,699 | * | 3/1982 | Hildebrand et al. | 333/237 |
| 4,325,039 | * | 4/1982 | Allebone | 333/237 |
| 4,800,351 | * | 1/1989 | Rampalli et al. | 333/237 |
| 5,276,413 | * | 1/1994 | Schulze-Buxloh | 333/237 |
| 5,291,164 | * | 3/1994 | Levisse | 333/237 |
| 5,422,614 | * | 6/1995 | Rampalli et al. | 333/237 |
| 5,467,066 | * | 11/1995 | Schulze-Buxloh | 333/237 |
| 5,705,967 | * | 1/1998 | Pirard | 333/237 |
| 5,809,429 | * | 9/1998 | Knop et al. | 455/523 |

FOREIGN PATENT DOCUMENTS

| | | |
|---|---|---|
| 41 06 890 | 5/1991 | (DE) . |
| 0 028 500 | 5/1981 | (EP) . |
| 0 502 337 | 9/1992 | (EP) . |
| 0 643 438 | 7/1994 | (EP) . |
| 0 694 986 | 7/1994 | (EP) . |
| 2 420 857 | 12/1978 | (FR) . |

* cited by examiner

*Primary Examiner*—Anthony Dinkins
*Assistant Examiner*—William H Mayo, III
(74) *Attorney, Agent, or Firm*—Ware, Fressola, Van der Sluys & Adolphson LLP

(57) ABSTRACT

A radiating coaxial high-frequency cable is provided with openings in the outer conductor which are in the form of slots (5) arranged substantially perpendicular to the cable axis. The slots (5) are arranged in sections which are arranged consecutively without gaps in the longitudinal direction of the cable and whose axial length is dimensioned according to the high-frequency energy to be transmitted. The number of slots (5) is greater in the sections which are farther away from the feed location of the high-frequency energy than in the sections which are closer to the feed location. When the length of the cable is increased, several sections (A) with an identical number of slots are arranged consecutively without gaps, provided that subsequent sections (A) have a larger effectual opening when the system damping between the high-frequency cable and an antenna located outside the cable reaches a predetermined value.

2 Claims, 2 Drawing Sheets

RADIATING COAXIAL CABLE

BACKGROUND OF THE INVENTION

1. Technical Field

The invention relates to a radiating coaxial high-frequency cable with openings in the outer conductor which are in the form of slots arranged substantially perpendicular to the cable axis and which are configured in sections which are arranged consecutively without gaps in the longitudinal direction of the cable and whose axial length is dimensioned according to the high-frequency energy to be transmitted, wherein the number of slots is greater in the sections which are farther away from the feed location of the high-frequency energy than in the sections which are closer to the feed location.

2. Description of the Prior Art

Radiating coaxial high frequency cables—hereinafter called "RHF-cables—operate essentially as antennae as a result of the electromagnetic energy which is transmitted to the outside through the slots in the outer conductor. These cables enable communication between transmitters and receivers which move relative to each other. The intensity of the radiated power decreases along the length of the RHF cable due to cable damping (longitudinal damping) and because HF energy is radiated (coupling damping). Consequently, the so-called "system damping" which is the sum of the longitudinal damping and coupling damping—for example between an antenna of a vehicle and a RHF cable—increases with increasing cable length measured from the location where the HF energy is fed into the RHF cable. To keep the field strength which is received by a receiver moving along the RHF cable, at least approximately constant, the effect of the longitudinal damping of the RHF cable described in DE 41 06 890 A1 is compensated with the help of a special slot configuration. The number of the slots along the cable increases here according to a predetermined rule. The cable with this configuration can then made longer than a RHF cable with a uniform slot arrangement. Nonetheless, the length of the RHF cable along which a "usable" signal can be received or coupled in, remains relatively short, in particular at higher operating frequencies.

A conventional RHF cable can operate over a greater length by using the cable design according to EP 0 643 438 A1. This RHF cable has consecutive sections wherein each section has a different number of slots. The electrically effectual size of the openings formed by the slots increases with increasing distance from the location where the HF energy is injected into the cable. The longitudinal damping of the longer RHF cable is also compensated, providing greater flexibility for tuning important properties of the transmission system. The cable also requires a lesser number of amplifiers and feed locations along the cable run. This RHF cable has proven effective in practice. However, the "usable" length of the cable—as defined above—is still limited, in particular at higher frequencies.

SUMMARY OF THE INVENTION

It is an object of the invention to improve the RHF cable described above so as to further increase its length without additional amplifiers and feed locations, in particular at higher frequencies.

This object is solved with the invention by arranging several sections with an identical number of slots consecutively without gaps, provided that the effectual opening of subsequent sections is increased when the system damping between the high-frequency cable and an antenna located outside the cable reaches a predetermined value.

The distance which can be covered with the RHF cable designed in this fashion, can be readily increased without requiring additional amplifiers or additional injection of HF energy. The effectual opening in the outer conductor of the RHF cable can be enlarged with increasing distance from the location where the HF energy is injected, by providing more slots which can be made of different size. In each section a sufficient number of larger slots can then advantageously be arranged on the outer conductor even if the sections of the RHF cable are relatively short in the axial direction and frequency-dependent. The original goal of attaining a "larger opening with increasing distance from the feed location" can thereby be met. In the sections which have a greater distance from the feed location, only slots which are quite long in the direction of the circumference, are provided in the outer conductor. A RHF cable designed in this fashion is easier to manufacture since, for example, only two different stamping tools are required to machine the slots. The smaller slots can be stamped first, while the longer slots are stamped later. It is possible to interleave sections with slots of different slot lengths.

The invention will be fully understood when reference is made to the following detailed description taken in conjunction with the accompanying drawings.

DETAILED DESCRIPTION OF THE INVENTION

Figure 1:
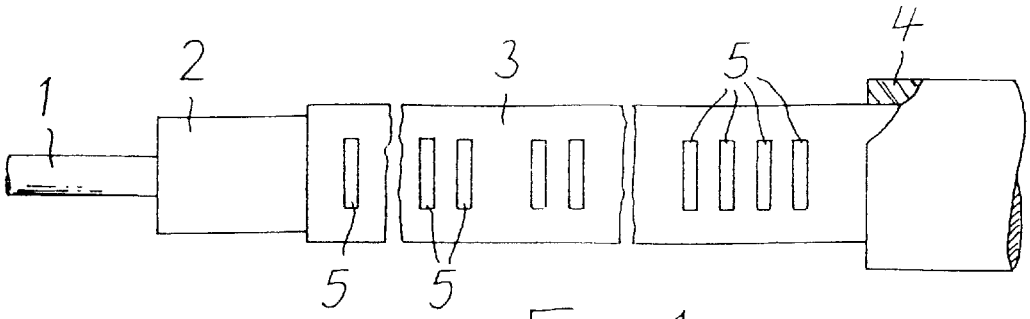
FIG. 1 is a schematic side view of a RHF cable according to the invention.

FIG. 1 shows a RHF cable which can be installed, for example, in a railway tunnel to transmit signals between stationary units and mobile units. The RHF cable has an inner conductor 1, a dielectric 2 and a tubular outer conductor 3 which concentrically surrounds the inner conductor 1. The outer conductor 3 is, for example, a longitudinal metal tape which is applied around the dielectric 3 in a way that the lateral tape edges overlap. The edges can be joined, for example, with an adhesive, by soldering or by welding. The lateral edges of the tape can also be welded to each other without overlap. A jacket 4 which is made of plastic and which can be flame-retardant, provides mechanical protection on the outside.

The inner conductor 1 and the outer conductor 3 are preferably made of copper. The dielectric 2 can be fabricated by conventional processes, i.e. it can be a tightly packed dielectric, including foam, or a hollow dielectric, including a helix or disks. The dielectric 2 is preferably made of materials with a small dielectric loss factor, for example polyethylene. The jacket 4 can be made of, for example, polyethylene or polyvinylchloride.

The outer conductor 3 is provided with slots 5 which in the illustrated embodiment are longer in the direction of the circumference than they are wide in the axial direction. The outer conductor 3 has a number of sections A which are arranged consecutively without gaps in the longitudinal direction of the RHF cable. Several sections A with the same number of slots 5 are arranged immediately adjacent to each other. Due to the slots 5, HF energy can be received outside the RHF cable with a suitable antenna. It is equally possible to couple HF energy into the RHF cable in the opposite transmission direction.

The number of slots 5 per unit length increases with increasing distance from the feed location E of the HF energy. The received signal has then an essentially constant level along the entire length of the RHF cable. This is illustrated schematically in FIG. 2 for only one section A by way of example. A unit length of the RHF cable includes all respective sections A which have the same number of slots 5. The axial length of the sections A depends on the frequency of the HF energy which is injected into the RHF cable. The sections A become shorter with increasing frequency. However, the basic design and arrangement of the slots 5 is presumed to be identical for all embodiments. The number of slots 5 for each section A is increased at regular intervals when the level of the received signal has reached or dropped below a predetermined value. In this way, the system damping between the RHF cable and an antenna located or moving outside the RHF cable can be very accurately maintained at a predetermined value.

Figure 2:
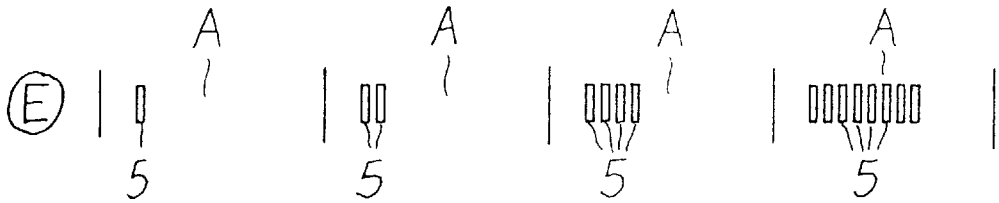
FIG. 2 is a schematic diagram of an arrangement of slots in the outer conductor of the RHF cable.

For example, a RHF cable with slots 5 arranged in section A according to the schematic diagram of FIG. 2 has, for example, the following form:

In the present example, a section A designed for the frequency range 1800 MHz (1710 MHz to 1920 MHz) as a length of the 8.5 cm. Sections A are arranged consecutively without gaps along a length (hereinafter referred to as unit length) of approximately 100 m, wherein each of the sections A has one slot 5. As a result, approximately 590 sections with only one slot 5 are arranged sequentially. Directly following, without a gap, is a length of approximately 90 m which has two slots 5 per section A, for a total of approximately 530 sections A. Each section A of the subsequent unit length of approximately 75 m has four slots, for a total of approximately 440 sections A. The final portion of the cable is formed by a unit length of approximately 55 m, wherein each section A has eight slots 5. This unit length then has approximately 320 sections A. The entire length of the corresponding RHF cable is approximately 320 m.

Figure 3:
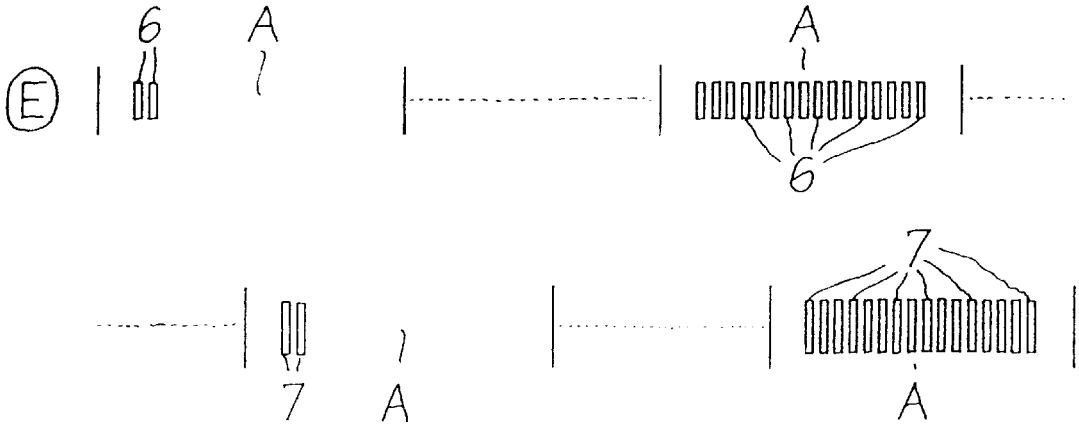
FIGS. 3 and 4 are schematic diagrams of a representation an arrangement of slots in the outer conductor of the RHF cable.

In FIG. 3, there is illustrated a preferred embodiment for arranging the slots 5 in the outer conductor 3. All sections A have once again the same axial length. In this embodiment, the RHF cable can have a total length of approximately 500 m. Only two different slot sizes are used. The small slots are indicated with the reference numeral "6" and the large slots with the reference numeral "7". All slots 6 and 7 have preferably the same width in the axial direction. The slots 7 are longer in the direction of the circumference of the RHF cable than the slots 6. For each respective number of slots, only one section A is shown in FIG. 3. This embodiment again has a large number of identically constructed and consecutively arranged sections A, as was described above with reference to the example of FIG. 2.

Since the HF signal is strongest at the beginning of the RHF cable, i.e. proximate to the location E where the HF energy is injected, the outer conduct 3 in this region need only have a small clear opening. Each section A therefore has only two slots 6. Several sections A with only two slots 6 each are then arranged consecutively until the level of the received signal reaches a predetermined lower limit. The subsequent sections A then have four slots 6 each. The sections A thereafter have eight slots 6, followed by sections A with sixteen slots 6. The subsequent sections A with the slots 7 have the same arrangement and sequence of slots. The outer conductor 3 in the terminal sections A has sixteen slots 7. The combined effectual electrical size of the two larger slots 7 which are located in a section with only two slots, is greater than the combined clear opening of the sixteen smaller slots 6 located the in the previous sections.

Figure 4:
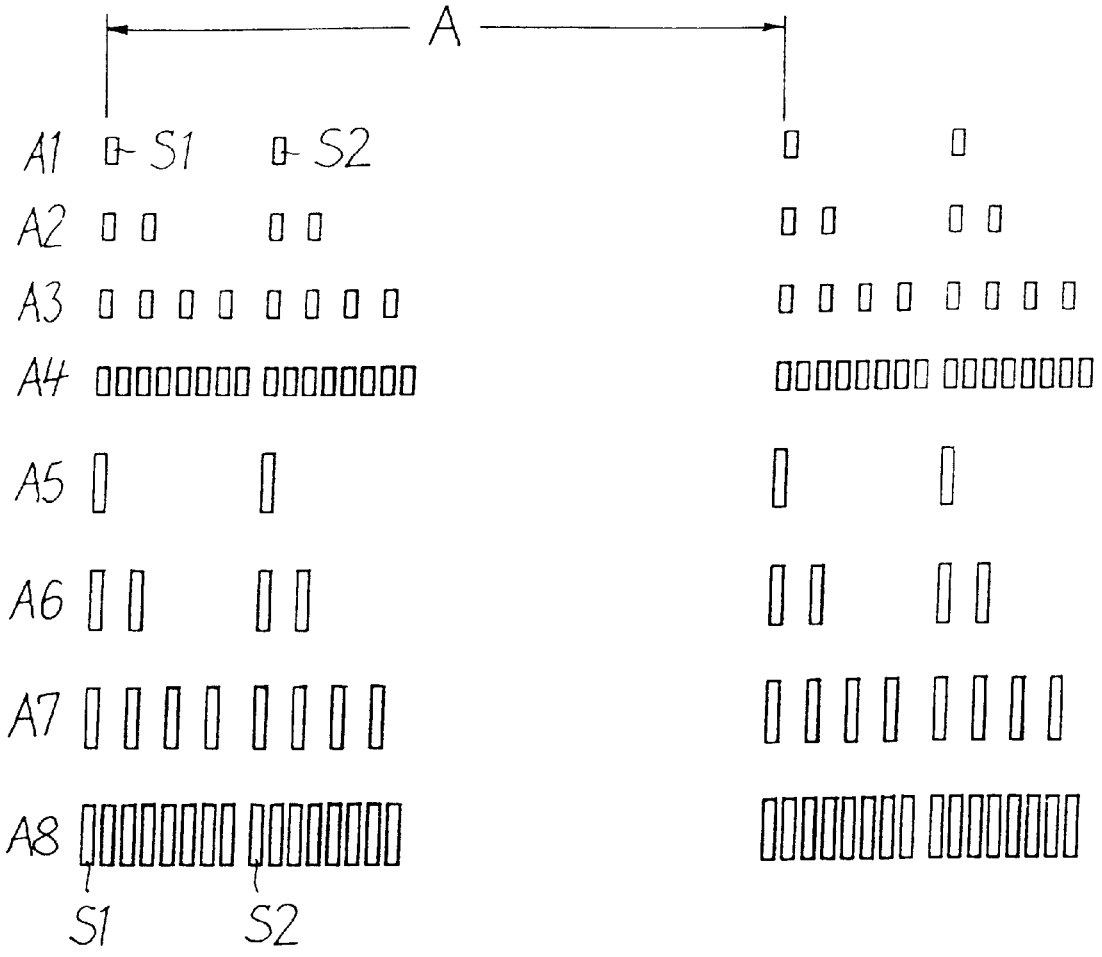

FIG. 4 shows a complete layout of the embodiment of the slot arrangement suggested in FIG. 3. A suitable number of respective sections A1 to A8 which each have a different number of slots 6 and 7, is arranged consecutively. The illustration of FIG. 3 shows only the slot arrangement for the individual sections.

In the embodiment illustrated in FIG. 4, the distance between the two slots S1 and S2 in section A1 is fixed. The distance corresponds, for example, to a quarter of the wavelength of the HF energy to be transmitted. This distance is maintained for the sections A2 to A8. At most sixteen slots 6 can then be arranged in sections A4 and A8, even if the respective section itself is longer. Because of the limited space, only seven slots 6 and 7, respectively, fit between the two slots S1 and S2. A total of sixteen slots 6 and 7, respectively, can be accommodated because of the symmetry of this arrangement.

The configuration of slots 6 and 7 differ from the arrangement illustrated in FIG. 4 for different wavelengths of the HF energy which is to be transmitted. For example, it is possible to have only one slot in each of the first sections A. The number of slots which can be arranged next to each other in each of the terminal sections A is only limited by the available space, i.e. the entire length of these sections A can be filled with slots 6 and 7, respectively.

In the embodiment of FIGS. 3 and 4, the sections A1 to A4 have exclusively smaller slots 6 whereas the subsequent sections A5 to A8 have exclusively larger slots 7. It will be understood by those skilled in the art that large slots 7 can also be used in the sections A2 to A4 if the large slots 7 in the outer conductor 3 have the same clear opening as the slots 6.

It is also possible to use more than two different slots sizes. The slots can then be arranged on the outer conductor 3 either according to size—similar to the arrangement depicted in FIGS. 3 and 4—or the slots can be interleaved. The length of the sections A can also vary, with the respective slot arrangements spaced closer to each other or farther apart from each other.

The RHF cable is preferably manufactured from a metal tape adapted to form the outer conductor 3, wherein the slots 5, 6 and 7, respectively, are formed in the metal tape already during preproduction. The respective slots are punched out of the metal tape in a continuous pass.

The embodiments described above admirably achieve the objects of the invention. However, it will be appreciated that departures can be made by those skilled in the art without departing from the spirit and scope of the invention which is limited only by the following claims.

What is claimed is:

1. A radiating coaxial cable for transmitting high-frequency energy from a feed location, comprising:

(a) a central conductor defining a cable axis;

(b) a dielectric surrounding the central conductor; and (c) an outer conductor which surrounds the central conductor and dielectric, the outer conductor having sections which are arranged consecutively without gaps in an axial direction of the cable, all sections have an equal axial length which is dimensioned according to the high-frequency energy to be transmitted, the outer conductor having slots in each section creating an effectual opening in each section, an initial plurality of the sections of the initial plurality of the sections with each section therein having an identical number of slots creating an effectual opening identical in size, the sections in the initial plurality of the sections arranged consecutively without gaps starting at the feed location of the high-frequency energy, and at least one subsequent plurality of sections subsequent to the initial plurality of the sections, each section in each individual one of the at least one subsequent plurality of sections having an identical number of slots creating an effectual opening larger than the effective opening of each section of the initial plurality of sections and any preceding subsequent plurality of sections, each section of the at least one subsequent plurality of sections beginning where system damping between the cable and an antenna located outside the cable reaches a predetermined value, the initial plurality of the sections and each section of theat least one subsequent plurality of sections define a first length having the slots with one slot size the slots of the one slot size are greater in number in the sections of the first length which are more distant from the feed location of the high-frequency energy than in the sections of the first length which are closer to the feed location and several sections of the first length with an identical number and arrangement of the slots of the one slot size directly abut each other at least one additional similarly constructed length of the outer conductor following the first length the effectual opening of the slots arranged in each of the sections of the at least one additional length of the outer conductor is larger than the effectual opening of the slots in each corresponding section of the first length wherein the slots in the first length and the at least one additional length have different sizes the slots for one slot size increase in number in the sections with increasing distance from the feed location of the high-frequency energy.

2. The cable according to claim 1, wherein the slots of the different sizes have a width which is identical in an axial direction of the cable but different lengths in a circumferential direction of the cable.

* * * * *

UNITED STATES PATENT AND TRADEMARK OFFICE

CERTIFICATE OF CORRECTION

PATENT NO. : 6,246,005 B1
DATED : June 12, 2001
INVENTOR(S) : Erhard Mahlandt and Karl Schulze-Buxloh It is certified that error appears in the above-identified patent and that said Letters Patent is hereby corrected as shown below:

Column 5, claim 1,
Line 21, "theat" should be -- the at --.

Column 6, claim 1,
Line 4, after "location", -- , -- should be inserted.

Signed and Sealed this

Nineteenth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,246,005 B1
DATED : June 12, 2001
INVENTOR(S) : Erhard Mahlandt and Karl Schulze-Buxloh It is certified that error appears in the above-identified patent and that said Letters Patent is hereby corrected as shown below:

Column 5,
Line 4, "of the initial plurality of the sections" should be deleted.
Line 5, -- of the initial plurality of the sections -- should be inserted after "section".

Signed and Sealed this

Fourteenth Day of May, 2002

*Attest:*

*Attesting Officer*

JAMES E. ROGAN
*Director of the United States Patent and Trademark Office*